United States Patent [19]

Smith

[11] 3,982,152

[45] Sept. 21, 1976

[54] CASCADE CROSSED FIELD DEVICE

[75] Inventor: William A. Smith, Winchester, Mass.

[73] Assignee: Raytheon Company, Lexington, Mass.

[22] Filed: Nov. 25, 1974

[21] Appl. No.: 526,651

[52] U.S. Cl. ..... 315/3.6; 315/3.5; 315/39.3; 330/43; 331/86

[51] Int. Cl.[2] ..... H01J 25/34

[58] Field of Search ..... 315/3.5, 3.6, 39.3, 315/39.51; 331/86, 88, 91; 330/43

[56] References Cited

UNITED STATES PATENTS

| | | | |
|---|---|---|---|
| 2,992,356 | 7/1961 | Paschke | 315/3.6 |
| 3,293,563 | 12/1966 | Nevins, Jr. | 315/3.6 X |
| 3,305,749 | 2/1967 | Hogg | 315/3.6 |
| 3,324,341 | 6/1967 | Epsztein | 315/3.6 |
| 3,508,110 | 4/1970 | Farney | 315/3.6 X |
| 3,774,119 | 11/1973 | Mashin et al. | 331/86 |
| 3,787,747 | 1/1974 | Scott | 315/3.6 |

*Primary Examiner*—Saxfield Chatmon, Jr.
*Attorney, Agent, or Firm*—Edgar O. Rost; Joseph D. Pannone; Milton D. Bartlett

[57] ABSTRACT

A crossed-field device having a plurality of slow wave energy propagating structures, each with an associated cathode, requires relatively low voltage for operation to provide a high power output. Electron beam current control is achieved by means of RF drive signals. Periodic permanent magnet focusing is utilized.

6 Claims, 4 Drawing Figures

CASCADE CROSSED FIELD DEVICE

BACKGROUND OF THE INVENTION

1. Field of the Invention

The invention relates to crossed-field microwave electron interaction devices.

2. Description of the Prior Art

Crossed-field electron interaction devices of the traveling wave type commonly include a periodic slow wave electromagnetic energy propagating structure such as a delay line. Mutually perpendicular unidirectional electric and magnetic fields in the interaction region combine to provide for interaction of electrons, emitted from a coaxial cathode, in an energy exchanging relationship with electromagnetic waves propagating along the slow wave structure. The principle of interaction between the electrons launched from the cathode and the electromagnetic waves is based on the synchronization of the electron beam velocity with the phase velocity of the waves on the slow wave structure to result in amplification and/or oscillation of high frequency electromagnetic energy. A DC potential is applied between the cathode and slow wave structure and the magnetic field is applied parallel to the axis of the cathode or transverse to the electrical field. Substantially high power microwave energy has been generated by such devices referred to as "Amplitrons."

The crossed-field devices are utilized as forward or backward wave amplifiers or oscillators in electromagnetic energy systems. The fields of the wave energy propagating along the slow wave structure provides space harmonic waves which travel with different phase velocities. By varying the electron velocity, synchronization with a desired phase velocity of the space harmonic wave component may be achieved. The phase and group velocities of some of the space harmonics are oppositely directed and these harmonics are referred to as backward waves. The other space harmonics are referred to as forward waves and are characterized in that the phase and group velocities are in the same direction. Amplification and generation of energy is obtained by the interaction between the electrons and the forward or backward wave. The group of devices referred to as M-type amplifiers are characterized in that the electron beam in the interaction region interact with space harmonic waves of either the forward or backward wave type. In such devices cold cathodes have not been successfully employed of such materials as tungstenthoria cermet, oxide-coatings, nickel, platinum coating and copper. Such cold cathodes have a high secondary electron emission ratio. The use of cold cathodes results in the elimination of electrical supplies required for the heater in the conventional thermionic-heated type cathodes.

The cold cathode is activated by an RF signal drive and sufficient numbers of gas molecules in the tube interaction region are typically present in the highly evacuated crossed-field devices to initiate bombardment of the cathode and provide for the emission of the secondary electrons. The electrons are circulated through the interaction region as a spoke-like space charge to interact with the waves on the slow wave structure. Efficiencies in the order of 70–75 percent are attainable with the Amplitron type devices and many thousands of watts and megawatts of power are attainable. Further particulars regarding the prior art crossed-field devices may be had by referring to U.S. Pat. Nos. 3,096,457 issued July 2, 1963 to W. A. Smith, Jr. and G. H. MacMaster and 3,646,388, issued Feb. 29, 1972 to K. W. Dudley and G. H. MacMaster, all assigned to the assignee of the present invention.

To develop high powers with low voltage operating requirements and high efficiencies is a continuing need in the microwave energy field. In light of the developing energy crisis throughout the world considerable effort is being undertaken in the evaluation of space oriented power stations utilizing solar energy. Such energy is converted into electrical energy which is in turn converted into microwave energy by sources provided on a space station and the microwave energy is beamed through space to earth stations to be converted into electrical power for distribution. An example of the space application is found in U.S. Pat. No. 3,781,647 issued Dec. 25, 1973 to Peter E. Glaser. The efficient conversion of electrical energy into microwave energy for transmission to earth stations warrents the use of high power crossed-field devices. Since radiation cooling, instead of liquid cooling normally used for high power tubes, is desired in space applications, an upper limit on the capability of present day crossed field devices exists. For the space applications it is desirable to provide crossed-field devices operating at power levels in the megawatt level. The primary objective of the present invention, therefore, is the provision of a crossed-field device having high power capabilities for possible utilization in solar energy-electrical power conversion systems or other similar energy-related programs.

SUMMARY OF THE INVENTION

In accordance with the teachings of the present invention a plurality of slow wave structures each having an associated cathode are disposed within an evacuated envelope in a cascade array. An RF drive is provided for the first slow wave structure along the array and crossed-field-type amplification results from the interaction of the secondary electrons and propagated waves. The second cascade structure is interconnected by energy transmission means and the amplified output of the first stage becomes the RF drive for the second stage.

The magnetic fields are provided by periodic magnetic means such as permanent magnets positioned adjacent to each stage of the cascade structures. Radially magnetized magnets may be employed for the magnetic field focusing. With the crossed periodic permanent magnet and electric structures the electron beam in the first stage is oriented to rotate in one direction while waves on the slow wave structure rotate in the opposite direction. In the second stage the crossed-fields provide for the directions of the amplified microwave energy along the slow wave structure and the electron beam to be opposite to those in the first stage. The alternating arrangement is carried on throughout the entire cascade arrangement until the last stage which yields the total amplified signal output to the utilization load. Each of the cascade stages operates in a typical crossed-field device manner and may be arranged to operate in either the forward wave or backward wave mode.

A feature of the invention is the efficient beam control to operate the device since the current is initiated through the application of the RF energy signals and is terminated by the removal of such signals. The beam control by means of the coupled energy represents a substantial improvement over the prior art wherein high gain tubes, illustratively having a 10–20 db gain, are required to provide substantial secondary electron emission when triggered by a low power RF drive signal. The conventional cold-cathode starting process is enumerated in the referenced U.S. Pat. No. 3,096,457. Crossed-field amplifiers, however, return a percentage of the input DC power as cathode back bombardment. It has been observed that for RF gains of greater than 3 db the secondary electron emission due to back bombardment exceeds that due to RF signal drive. As a result, if the RF signal is removed the tube continues to draw current. In the present invention each of the cascade stages is designed to optimize the compromise between high gain and cathode back bombardment. Hence, if the 3 db value is of critical importance in the control of the secondary electron emission, then each cascade stage may have the appropriate gain value. The overall cascade array will have a high cumulative overall gain with the additional advantage of RF drive signal beam control. Such beam control in prior art devices required the provision of arc-shaped control segments within the slow wave structure. Cessation of interaction occurred by the "brute force" technique of pulling all of the electrons into the control electrode which is rendered positive to thereby terminate operation. Such additional structures are both costly and require the utilization of additional voltage supplies.

In addition to the advantage of efficient beam control the present invention provides a device having a high power output and high efficiency requiring a relatively low operating voltage. Each stage may be provided with cooling fins to radiate and dissipate thermal energy generated during operation. Collectively the total radiation area will far exceed any structure provided in a prior art device having a very large cathode and large number circumferentially disposed resonators. The utilization of a number of devices each having a plural number of stages with the accompanying features of the low voltage operating conditions, as well as the additional cathode area together with reliability and beam control, will result in a more efficient and less costly device. In addition if a large number of separate devices each with its own envelope and RF input and output were employed, a substantial overall insertion loss as well as cost results.

BRIEF DESCRIPTION OF THE DRAWINGS

The invention as well as details of an illustrative embodiment will be readily understood after consideration of the following description together with the accompanying drawings, wherein.

DESCRIPTION OF THE PREFERRED EMBODIMENT

Figure 1:
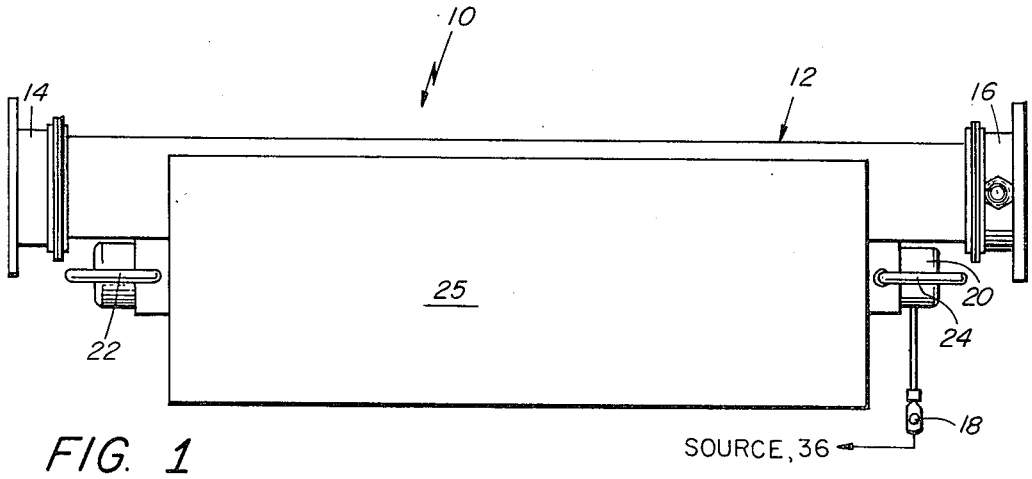
FIG. 1 is an isometric view of the overall illustrative embodiment.

Referring to the drawings the embodiment of the invention comprises a crossed-field amplifier 10 including an envelope 12 within which the cathode and slow wave structures embodying the invention are disposed as will be hereinafter described. Microwave frequency energy is provided by input coupler 14 which has been illustrated as rectangular waveguide although any other means such as coaxial transmission lines may be employed. The amplified energy is connected to a utilization load by means of output coupler means 16 disposed at the opposing end of the envelope. The DC voltage source for the provision of the transverse electric field between the cathode and slow wave structure is connected to cathode terminal 18. To isolate the voltage line from adjacent tube structures, high voltage bushings 20 are provided. The embodiment may be operated with or without a liquid coolant. To provide a fluid coolant capability, conduit means 22 and 24 are coupled to a conventional coolant source. For space application radiation fins 30 shown in FIG. 3 are provided for each stage.

A periodic permanent magnet system 25 surrounds the envelope to provide for the alternating polarity magnetic field disposed along the longitudinal axis of the overall device. Such a magnetic circuit system may be provided by segmented magnets which are radially magnetized as taught in U.S. Pat. No. 2,781,592 issued Dec. 25, 1973 to William Harrold and assigned to the assignee of the present invention. The periodic permanent magnet system is substantially similar to those systems employed in traveling wave devices to provide for the alternating field configurations as well as the electron beam trajectory focusing.

Figure 2:
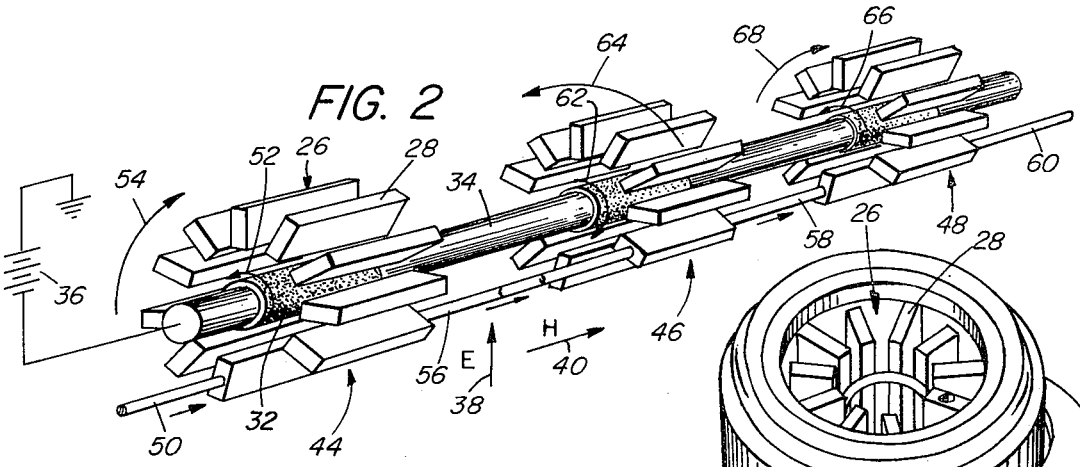
FIG. 2 is an isometric view of the cathode-slow wave structure of the illustrative embodiment.
Figure 3:
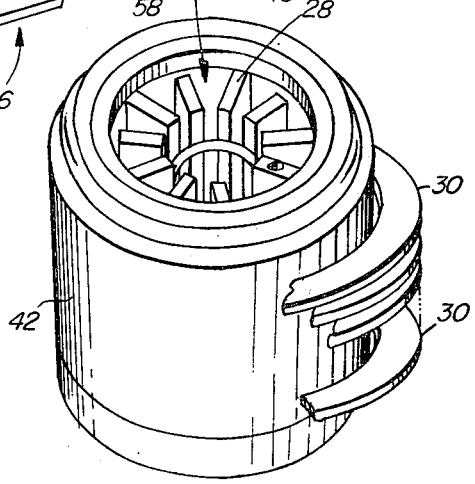
FIG. 3 is a view of an assembled stage incorporating the slow wave structure of the cascade array.

Referring now to FIG. 2, a three stage device is illustrated and FIG. 3 is a view of an assembled single stage slow wave structure. The slow wave structure 26 includes a plurality of circularly arranged elements 28 which may be rectangular plate members or rods with plate members, as described in the referenced U.S. Pat. No. 3,096,457.

Cathode member 32 is centrally disposed within each of the slow wave structures and comprises a relatively high secondary electron emission ratio material. The cathode assemblies in each of the stages of the overall device are supported by an elongated rod 34. A high unidirectional electric field is established between the cathode 32 and the slow wave structure 26 by means of a source 36. The electric field is directed transversely between the cathode and slow wave structure as indicated by E arrow 38 while the magnetic field extends in a mutually perpendicular direction or parallel to the longitudinal axis of the cathode support rod 34 as indicated by H arrow 40. The slow wave structure is supported within envelope body member 42 with each stage of the cascade array having substantially similar components.

Referring again to FIG. 2 a three stage cascade array is shown comprising first stage 44, the intermediate stage 46 and the final or output stage 48. All of the stages are interconnected by coaxial or rectangular waveguide transmission means first coupled to the first stage 44 and illustrated as a coaxial line 50. The first stage 44 is provided with the electron beam trajectory in a counterclockwise direction as indicated by the arrow 52. The energy propagating along the slow wave structure 26 is illustrated as being in a clockwise direction, as shown by arrow 54.

The second stage 46 is interconnected to the output of the first stage by transmission means 56. The amplified output signal of the first stage then becomes the input signal for the second stage with the gain from the first stage being added to the gain of the second stage.

The third stage 48 is driven by energy transmission 58 and the cumulative gain of all the stages in the cascade array becomes the output signal which is connected to coupling means 60 from the last stage 48.

The direction of electron flow and electromagnetic energy flow in the second stage is indicated by the arrows 62 and 64 and it will be noted that the orientation is opposite to that of the first stage. Similarly, the last stage 48 has the direction of the electron flow and electromagnetic energy flow oppositely disposed to the second stage or similar to the first stage 44 as indicated by the arrows 66 and 68.

It has been observed in high power crossed-field devices that there is an inherent characteristic of continual increase in efficiency with an increase in the electromagnetic energy signal driving power. In the illustrative embodiment, however, each of the stages has a gain parameter selected to optimize secondary electron emission without the effects of cathode bombardment. By maintaining the gain parameter at the 3 db or less level, each stage will cease to draw current when the drive signal is removed. Consequently, a very efficient beam control is provided by means of controlling the on and off cycles of the electromagnetic energy signal drive. The output of the first stage becomes the input for the second stage and with the additional gain in the second stage a much larger drive signal becomes the input of the next and each succeeding stage with the cumulative gain being available for the utilization load. In FIG. 2 a three stage device is illustrated which has an expected output signal gain of approximately 6 to 8 db.

Figure 4:
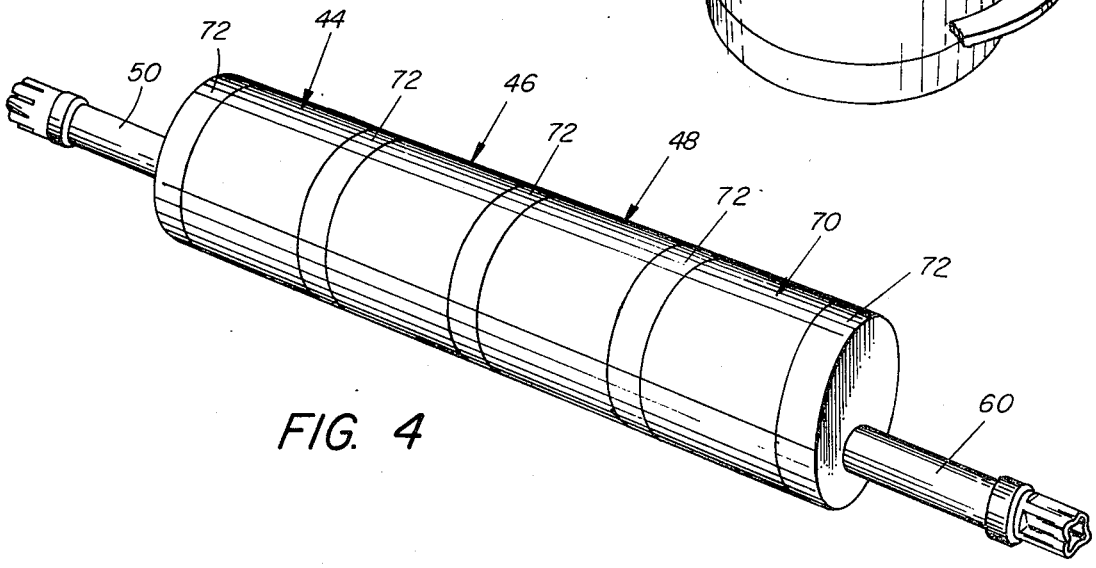
FIG. 4 is an isometric view of a plurality of coupled crossed-field stages in a cascade array embodying the invention.

In FIG. 4 a four-stage device is illustrated with the first three stages being similarly designated as in FIG. 2 and the additional stage being indicated by the numeral 70. The individual stages are assembled with intervening spacer means 72. The input and output energy signals are coupled by means of coaxial lines 50 and 60, as previously described in connection with FIG. 2. The four-stage device will have an expected gain of approximately 10 db. In the practice of the invention the number of stages is determined by insertion loss considerations and four or five stages will generally be preferred. Any number of devices, however, may be employed in a system.

The disclosed device incorporating a plurality of cascaded stages, each incorporating slow wave structures with a separate associated cathode, within a single envelope provides a high power output capability with high efficiency and requires low voltage operation. The operation of the device is uniquely controlled by means of the on and off cycles of the electromagnetic energy drive signals since the gain per stage of the cascade array is carefully controlled to fall in the region where cathode back bombardment will not result in the continued operation after the removal of the drive signal. Hence, while each individual stage is maintained at the gain level below which cathode bombardment does not adversely affect electron emission, the combined output of all of the stages results in a high power device operated at low voltage with relatively high efficiency.

Numerous modifications, such as the incorporation of waveguide interstage coupling, will be apparent to those skilled in the art. The foregoing detailed description of an illustrative embodiment is, therefore, to be considered in its broadest aspects and not in a limiting sense.

I claim:

1. A crossed-field traveling wave electron interaction device comprising:

an envelope;

a plurality of axially aligned electrically coupled energy amplifier stages in a cascade array disposed within said envelope;

each of said cascaded stages comprising a slow wave structure for propagating electromagnetic wave energy having input and output energy coupling means; and plural means for generating and directing electrons along a path adjacent to each said slow wave structure to interact in energy exchanging relation with said propagating wave energy;

means for providing mutually perpendicular electric and magnetic fields along said interaction paths;

means for coupling electromagnetic wave energy drive signals to said input coupling means of a first of said cascade stages to initiate operation;

means for intercoupling wave energy signals from the output coupling means of said first stage to subsequent stage input coupling means to sequentially cause operation of each succeeding stage; and means for coupling the combined energy amplified output signals from the output coupling means of the last stage in the array to a utilization load.

2. The crossed field device according to claim 1 wherein said electron generation means comprise a cold cathode for supplying electrons substantially entirely by secondary electron emission controlled by said input energy drive signals to each of said stages.

3. The crossed field device according to claim 2 wherein the device operation is controlled solely by application of said input drive signals to said first stage.

4. The device according to claim 1 wherein said means for coupling said input drive and energy output signals comprise rectangular waveguide transmission line.

5. The device according to claim 1 wherein said means for coupling said input drive and energy output signals comprise coaxial waveguide transmission line.

6. The device according to claim 1 wherein thermal energy radiation means are provided for each of said stages.

* * * * *